US007828604B1

(12) United States Patent
Lai

(10) Patent No.: US 7,828,604 B1
(45) Date of Patent: Nov. 9, 2010

(54) CONNECTOR ASSEMBLY

(75) Inventor: Ming-Chun Lai, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 12/453,898

(22) Filed: May 27, 2009

(51) Int. Cl.
*H01R 13/64* (2006.01)

(52) U.S. Cl. ..... 439/677; 439/660; 439/607.4

(58) Field of Classification Search ..... 439/677, 439/680, 660, 607.2, 607.35
See application file for complete search history.

(56) References Cited

U.S. PATENT DOCUMENTS 5,108,311 A * 4/1992 Nakazawa ..... 439/607.32
5,376,022 A * 12/1994 Carr et al. ..... 439/668
6,582,244 B2 * 6/2003 Fogg et al. ..... 439/362
2001/0009824 A1 * 7/2001 Kusagaya ..... 439/677
2004/0110425 A1 * 6/2004 Miyake et al. ..... 439/677

* cited by examiner

*Primary Examiner*—Hien Vu
(74) *Attorney, Agent, or Firm*—Rosenberg, Klein & Lee

(57) ABSTRACT

A connector assembly includes a plug connector having a base body and at least one inserting portion extended from a front of the base body. The inserting portion has a substantially circular plug groove of which an inner wall has a portion formed with an anti-mismating portion of plane shape. The anti-mismating portion has a null terminal recess for receiving a null terminal. A socket connector coupled with the plug connector defines an insulating housing having at least one receiving groove at a front surface thereof and a substantially circular receiving portion surrounded by the receiving groove. The receiving portion has a portion formed with an anti-mismating face of plane shape, corresponding to the anti-mismating portion, with a null pin recess formed thereon. A null pin is received in the null pin recess for electrically connecting with the null terminal of the plug connector.

5 Claims, 9 Drawing Sheets

CONNECTOR ASSEMBLY

BACKGROUND OF THE INVENTION

1. Field of the Invention

The present invention relates to a connector assembly, and more particularly to a connector assembly having a structure capable of guiding the plug connector to correctly mate with the socket connector.

2. The Related Art

In general, a conventional connector assembly includes a plug connector and a socket connector. The plug connector has inserting portions and a plurality of plug terminals received in the inserting portions. The socket connector has receiving grooves for receiving the inserting portions and a plurality of socket pins disposed in the receiving grooves for electrically connecting with the plug terminals. Nevertheless, it is easy and often to cause a wrong insertion between the plug connector and the socket connector, as the carelessness or faulty operation, which not only affects normal use but also ca use a potential accident. So there is a need to provide a connector assembly that overcomes the above-mentioned problem.

SUMMARY OF THE INVENTION

Accordingly, an object of the present invention is to provide a connector assembly having a structure capable of guiding the plug connector to correctly mate with the socket connector.

The connector assembly includes a plug connector having a base body and at least one inserting portion extended from a front of the base body. The inserting portion has a substantially circular plug groove of which an inner wall has a portion formed with an anti-mismating portion of plane shape. The anti-mismating portion has a null terminal recess for receiving a null terminal. A socket connector coupled with the plug connector defines an insulating housing having at least one receiving groove at a front surface thereof and a substantially circular receiving portion surrounded by the receiving groove. The receiving portion has a portion formed with an anti-mismating face of plane shape, corresponding to the anti-mismating portion, with a null pin recess formed thereon. A null pin is received in the null pin recess having a resisting portion projecting outside the anti-mismating face for electrically connecting with the null terminal of the plug connector when the plug connector is inserted into the socket connector.

As described above, the plug groove of the plug connector has the anti-mismating portion, and the receiving portion of the socket connector has the anti-mismating face corresponding to the anti-mismating portion of the plug connector, which is excellent to guarantee the correct engagement between the plug connector and the socket connector, thereby avoiding a potential danger in use.

BRIEF DESCRIPTION OF THE DRAWINGS

The present invention will be apparent to those skilled in the art by reading the following description of an embodiment thereof, with reference to the attached drawings, in which.

DETAILED DESCRIPTION OF THE PREFERRED EMBODIMENT

Figure 1:
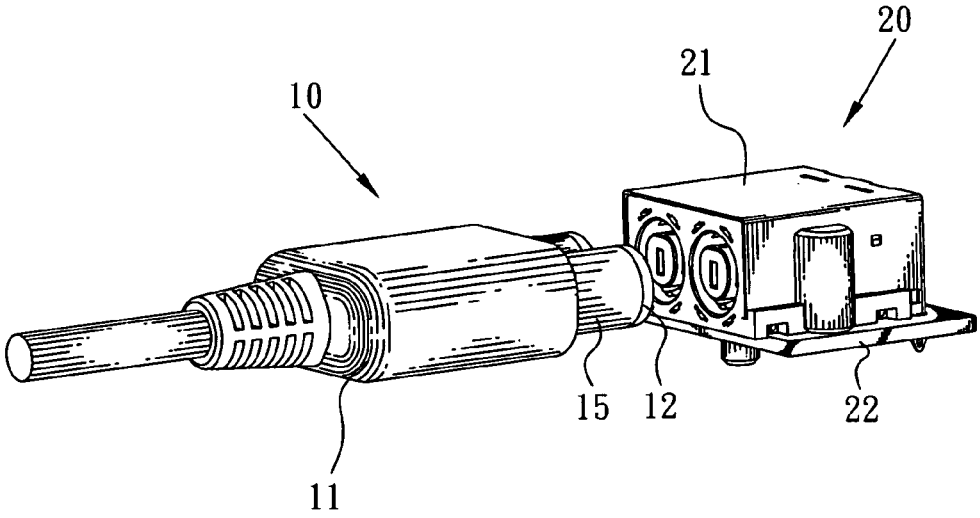
FIG. 1 is a perspective view of a connector assembly according to the present invention.

With reference to FIG. 1, a connector assembly according to the present invention includes a plug connector 10 and a socket connector 20.

Figure 2:
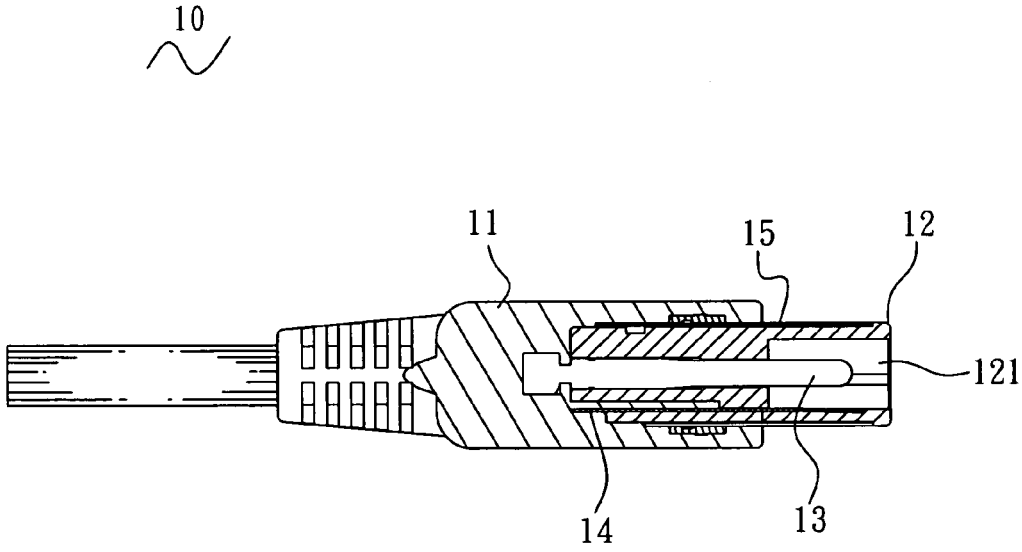
FIG. 2 is a partly cross-sectional view of a plug connector of the connector assembly shown in FIG. 1.

Please refer to FIG. 1 and FIG. 2, the plug connector 10 includes a base body 11, at least one inserting portion 12 fixed on a front of the base body 11. A power terminal 13, a null terminal 14 and a ground terminal 15 are all mounted to the inserting portion 12. In this embodiment, two inserting portions 12 are disposed side by side on the base body 11.

Figure 3:
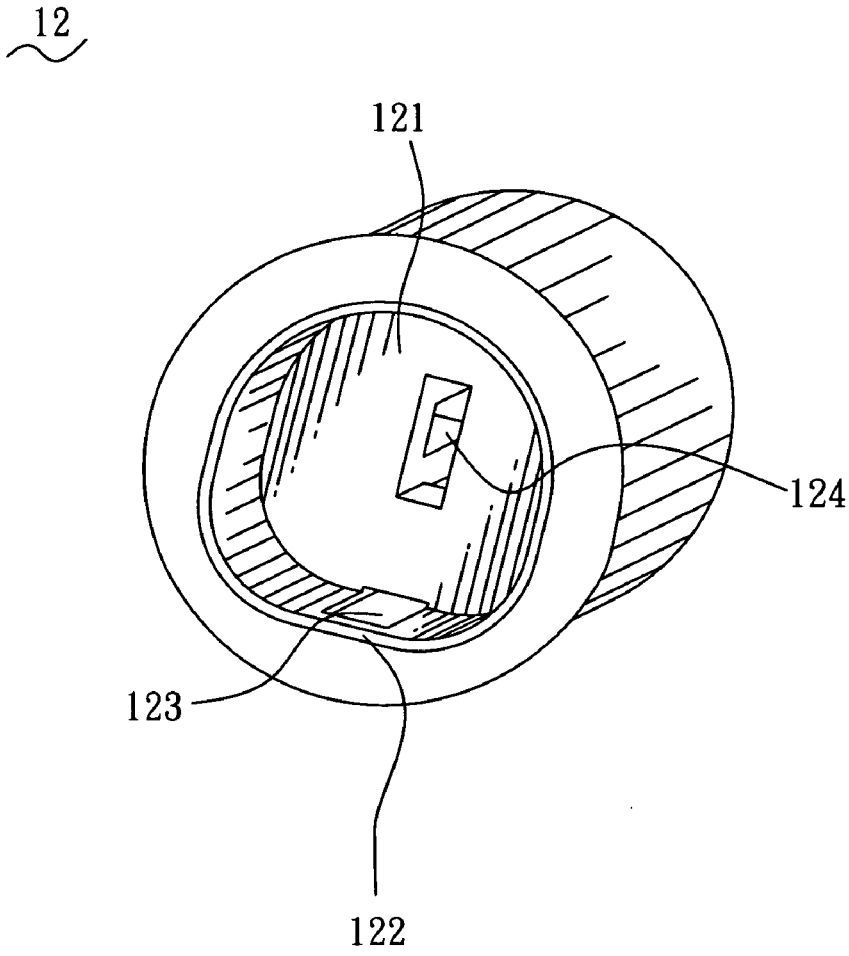
FIG. 3 is a perspective view of an inserting portion of the plug connector shown in FIG. 2.

Please refer to FIG. 2 and FIG. 3, the inserting portion 12 has a circular plug groove 121. An inner wall of the plug groove 121 has a portion shaped as plane, named as an anti-mismating portion 122, for preventing the plug connector 10 from being incorrectly inserted into the socket connector 20. A null terminal recess 123 for receiving the null terminal 14 forms on the anti-miss mating portion 122 and reaches to a bottom of the plug groove 121. The bottom of the plug groove 121 has a power terminal recess 124 at a middle portion thereof. The power terminal 13 is a long strip shape. One end of the power terminal 13 is received in the power terminal recess 124 and the other end is stretched into the plug groove 121. The ground terminal 15 is a cylinder shape, enclosing a periphery of the inserting portion 12.

Figure 4:
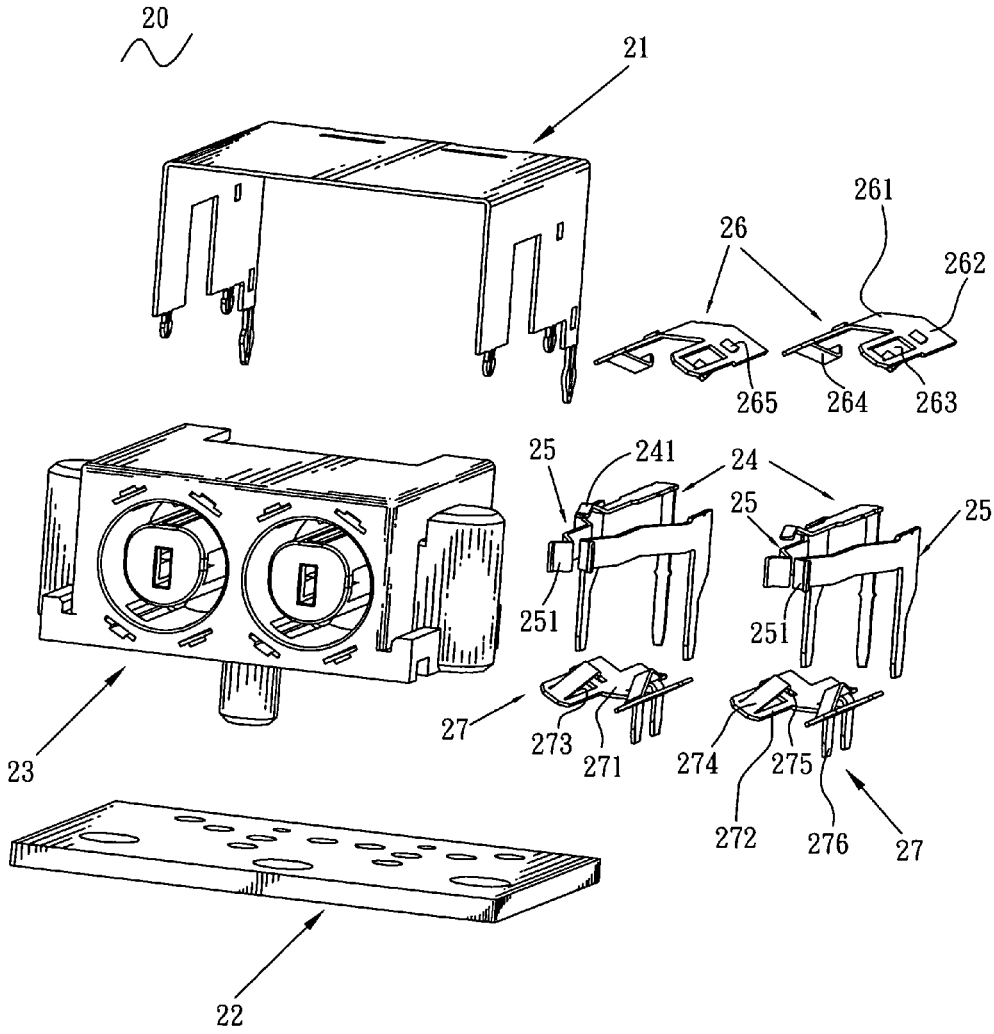
FIG. 4 is an exploded view of a socket connector of the connector assembly shown in FIG. 1.
Figure 5:
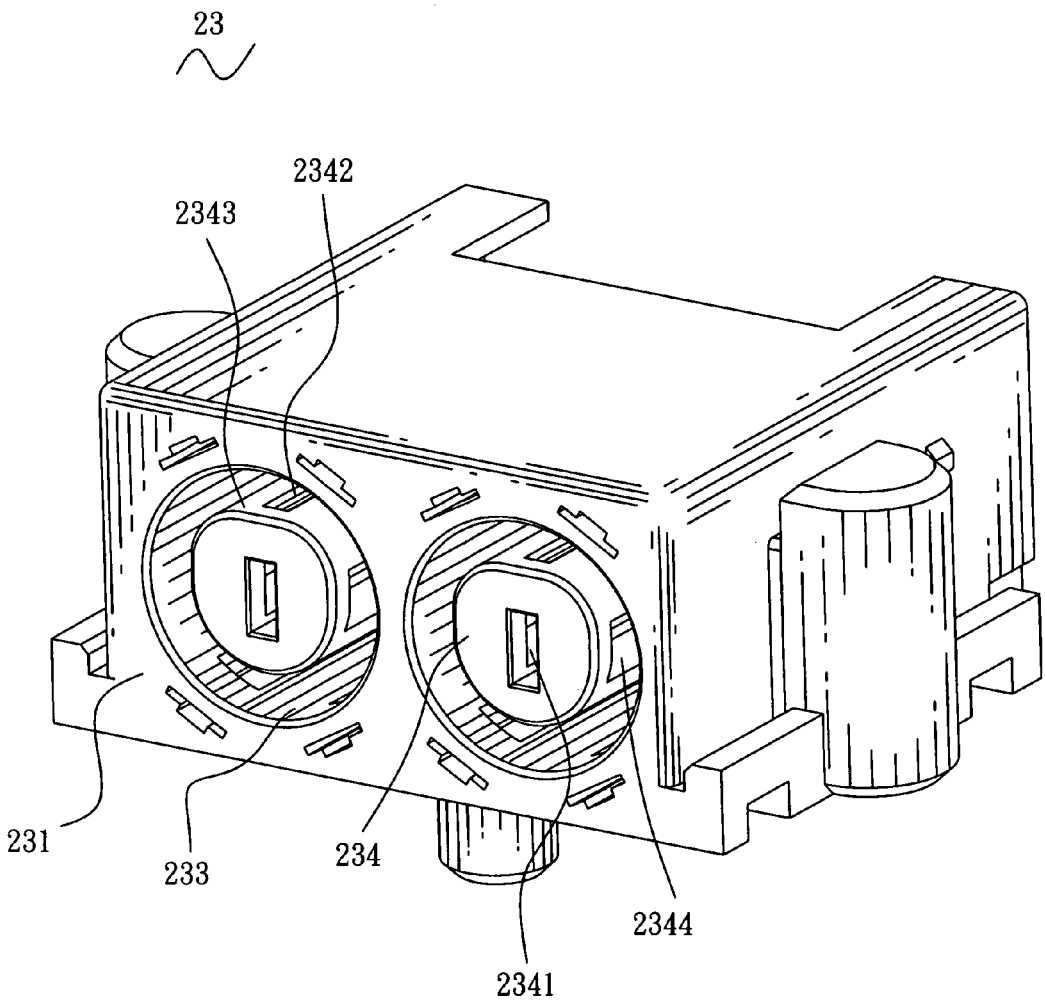
FIG. 5 is a perspective view of an insulating housing of the socket connector shown in FIG. 4.
Figure 6:
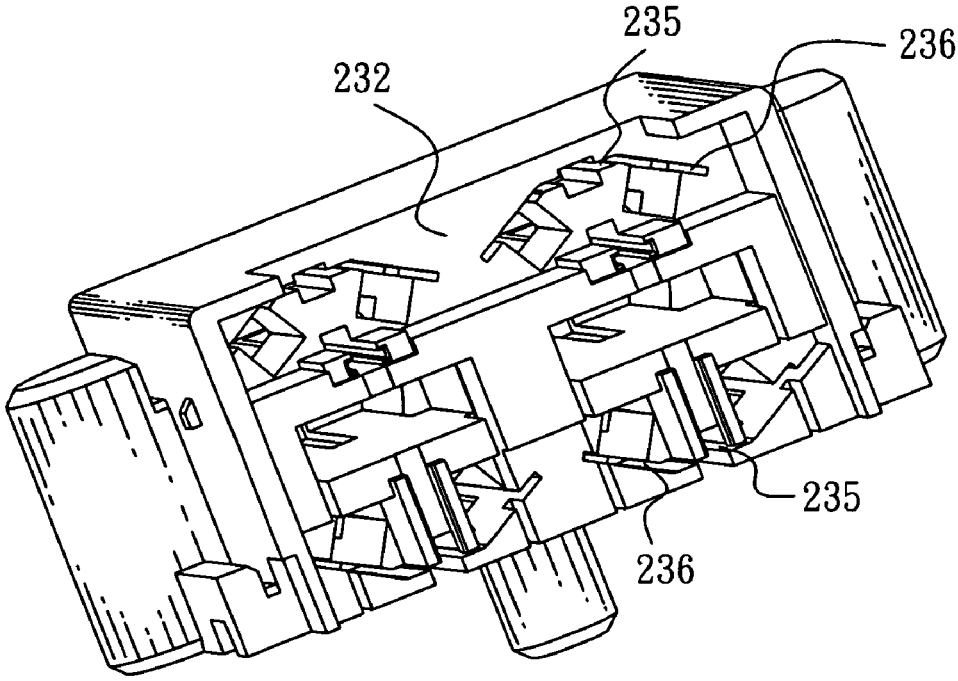
FIG. 6 is a perspective view of the insulating housing of the socket connector shown in FIG. 5 seen from another direction.
Figure 7:
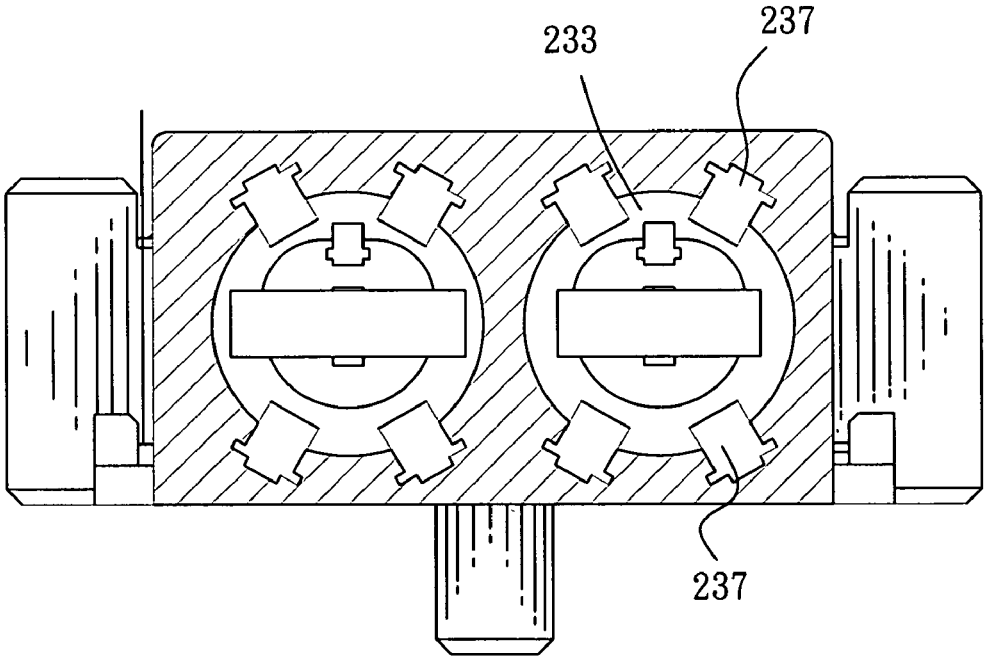
FIG. 7 is a cross-sectional view of the insulating housing of the socket connector shown in FIG. 5.
Figure 8:
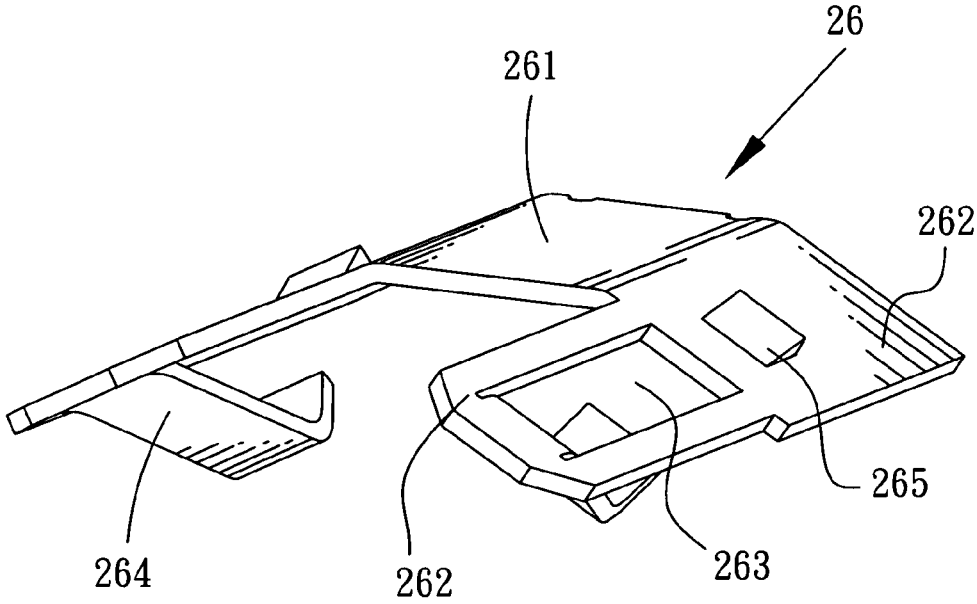
FIG. 8 is a perspective view of a first fixing spring of the socket connector shown in FIG. 4.
Figure 9:
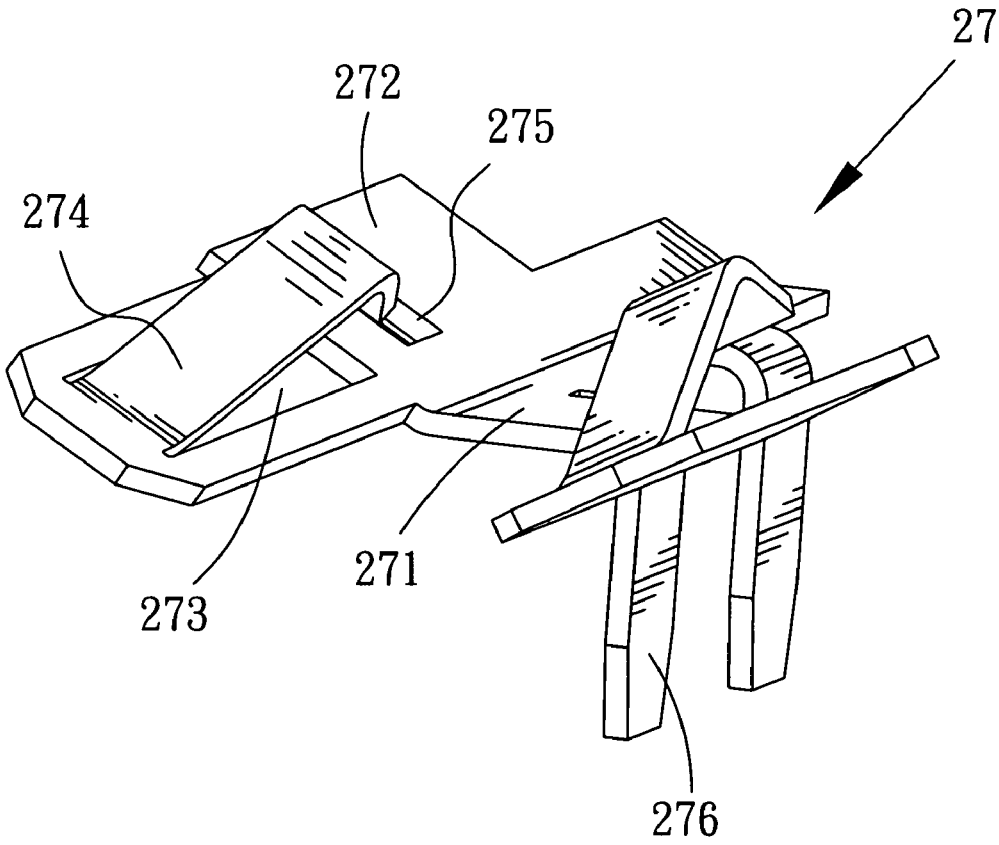
FIG. 9 is a perspective view of a second fixing spring of the socket connector shown in FIG. 4.

With reference to FIG. 1 and FIG. 4, the socket connector 20 defines an insulating housing 23 of a rectangle block shape mounted on a rectangular plate 22, and a metal shell 21 covered on the insulating housing 23.

With reference to FIGS. 4-7, the insulating housing 23 defines a front surface 231 and a rear surface 232. The front surface 231 has at least one ring-shaped receiving groove 233 corresponding to the inserting portion 12 of the plug connector 10 and a receiving portion 234 surrounded by the receiving groove 233. In this embodiment, two receiving grooves 233 are arranged side by side at the front surface 231 of the insulating housing 23. The receiving portion 234 has a rectangular hole 2341 at a front thereof, a null pin recess 2342 at a top thereof which is shaped to show a plane, named as an anti-mismating face 2343, corresponding to the anti-mismating portion 122, and two power pin recesses 2344 arranged symmetrically at two lateral surfaces thereof and communicating with the rectangular hole 2341. The rear surface 232 of the insulating housing 23 has at least one fixing slot 235 adjacent to the receiving groove 233. In this embodiment, two fixing slots 235 are arranged at an upper portion and a lower portion of the rear surface 232, symmetrical about the receiving groove 233. Two wing slots 236 adjacent to the receiving groove 233 extend away from each other from two opposite sides of the fixing slot 235. Each of the wing slots 236 passes through the whole insulating housing 23 and has a side adjacent to the receiving groove 233 formed with a trough 237. The trough 237, having a closed front end, communicates with the receiving groove 233.

The socket connector 20 further includes a null pin 24 and two power pins 25. The null pin 24 of an inverted-L shape is partially received in the null pin recess 2342 and has a resisting portion 241 projecting into the receiving groove 233, for electrically connecting with the null terminal 14 of the plug connector 10. The power pin 25 received in the power pin recess 2344 has a contacting portion 251 projecting into the rectangular hole 2341. When the plug connector 10 is coupled with the socket connector 20 under the guide of the anti-mismating portion 122 and the anti-mismating face 2343, the end of the power terminal 13 located in the plug groove 121 will be inserted into the rectangular hole 2341 and clipped by the contacting portions 251 from opposite directions. Two fixing elements 26, 27 are provided and mounted to the insulating housing 23. The fixing element 26 has a fixing slice 261 located in the fixing slot 235, and two wing slices 262 symmetrically depending from two opposite sides of the fixing slice 261, with an obtuse angle formed therebetween, and received in the corresponding wing slots 236. The wing slices 262 are substantially rectangular shape, each of which has an extending portion frontward of the fixing slice 261, with an opening 263 formed thereon. A front side of the opening 263 is extended apart from the wing slice 262 to form a resisting arm 264, projecting into the receiving groove 233 from the trough 237 for abutting the inserted plug connector 10, in assembly. The wing slice 262 is formed with a buckling piece 265 adjacent to the opening 263. The buckling piece 265 rests against a sidewall of the wing slot 236 for fixing the fixing element 26 to the insulating housing 23. The fixing element 27 located adjacent to a bottom of the insulating housing 23 is substantially the same structure as the fixing element 26 except for two breast grounding pegs 276. The grounding peg 276 is bent downward from a rear side of the fixing slice 271 and extended out of the bottom of the insulating housing 23 for being grounded.

As described above, the plug groove 121 of the plug connector 10 has the anti-mismating portion 122, and the receiving portion 234 of the socket connector 20 defines the anti-mismating face 2343 corresponding to the anti-mismating portion 122 of the plug connector 10, which is excellent to guarantee the correct engagement between the plug connector 10 and the socket connector 20, thereby avoiding a potential danger in use. Meanwhile, The resisting arms 264, 274 of the wing slices 262, 272 project into the receiving groove 233 of the insulating housing 23 for abutting the inserted plug connector 10, which can insure the steady connection between the plug connector 10 and the socket connector 20 in a long usage time.

The foregoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A connector assembly, comprising a plug connector having a base body and at least one inserting portion extended from a front of the base body, the inserting portion having a substantially circular plug groove of which an inner wall has a portion formed with an anti-mismating portion of plane shape, the anti-mismating portion having a null terminal recess for receiving a null terminal; and a socket connector coupled with the plug connector, comprising:

an insulating housing having at least one receiving groove at a front surface thereof and a substantially circular receiving portion surrounded by the receiving groove, the receiving portion having a portion formed with an anti-mismating face of plane shape, corresponding to the anti-mismating portion, with a null pin recess formed thereon, a rear surface of the insulating housing having at least one fixing slot adjacent to the receiving groove, two wing slots being adjacent to the receiving groove extending away from each other from two opposite sides of the at least one fixing slot, each of the wing slots passing through the whole insulating housing and communicates with the receiving groove, at least one fixing element having a fixing slice being located in the fixing slot, and two wing slices symmetrically depending from two opposite sides of the fixing slice, with an obtuse angle formed therebetween, the wing slice being received in the corresponding wing slot having a resisting arm biased from a plane of the wing slice and projecting into the receiving groove for abutting the inserted plug connector; and a null pin received in the null pin recess having a resisting portion projecting outside the anti-mismating face for electrically connecting with the null terminal of the plug connector when the plug connector is inserted into the socket connector.

2. The connector assembly as claimed in claim 1, wherein each of the wing slots has a side adjacent to the receiving groove formed with a trough, the trough communicates with the receiving groove for allowing the resisting arm to pass therethrough.

3. The connector assembly as claimed in claim 1, wherein both of the wing slices are substantially rectangular shape, each has an extending portion perpendicular to the fixing slice to form an opening, the resisting arm is extended apart from the wing slice from a front side of the opening.

4. The connector assembly as claimed in claim 3, wherein the wing slice is formed with a buckling piece for resting against a sidewall of the wing slot for fixing the fixing element.

5. The connector assembly as claimed in claim 3, wherein two fixing elements are symmetrically arranged around the receiving groove, the fixing elements located adjacent to a bottom of the insulating housing further has two breast grounding pegs, the grounding peg is bent downward from a side of a rear portion of the fixing slice and extends out of the bottom of the insulating housing.

* * * * *